United States Patent [19]

Sivilich

[11] Patent Number: 4,458,468

[45] Date of Patent: Jul. 10, 1984

[54] METHOD FOR PRODUCING NON-PLANAR SANITARY NAPKINS

[75] Inventor: Daniel M. Sivilich, East Hanover, N.J.

[73] Assignee: International Playtex, Inc., Stamford, Conn.

[21] Appl. No.: 401,664

[22] Filed: Jul. 26, 1982

[51] Int. Cl.[3] ..... B65B 5/06; B65B 35/40; B65B 63/00

[52] U.S. Cl. ..... 53/428; 53/431; 53/445; 53/474

[58] Field of Search ..... 53/428, 429, 431, 445, 53/467, 473, 474, 440, 542

[56] References Cited

U.S. PATENT DOCUMENTS 1,192,439 7/1916 Luellen ..... 604/377
2,577,765 12/1951 Irmscher ..... 53/467
3,439,469 4/1969 Van Mil, Jr. ..... 53/429
3,696,187 10/1972 Glassman ..... 264/294

*Primary Examiner*—Robert L. Spruill
*Assistant Examiner*—Donald R. Studebaker
*Attorney, Agent, or Firm*—Stewart J. Fried

[57] ABSTRACT

A method for packaging and shaping sanitary napkins (10) in a container (44) is described. The method comprises advancing a succession of pre-moistened, embossed sanitary napkins (10) along a predetermined path (30), deflecting the ends of the napkins (10) by means of deflector guides (32) to impart a non-planar shape to the napkins (10), introducing the napkins (10) into a container (44) which provides packaging therefor, and reducing the moisture content in the napkins (10). After the moisture content is sufficiently reduced, e.g., as by evaporation during commercial storage or shipment, the napkins (10) retain their non-planar, curved shape after removal from the container (44) for individual use.

9 Claims, 4 Drawing Figures

FIG. 1
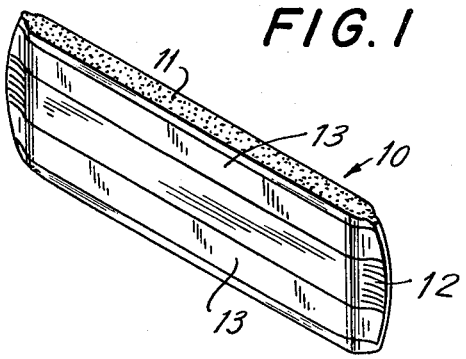
FIG. 3
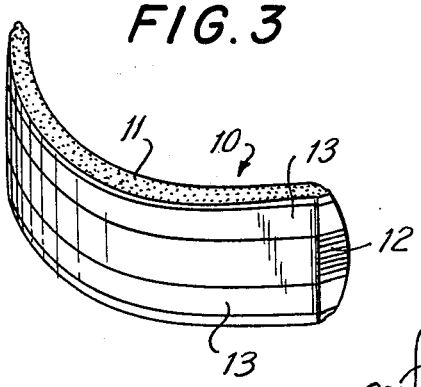
FIG. 2
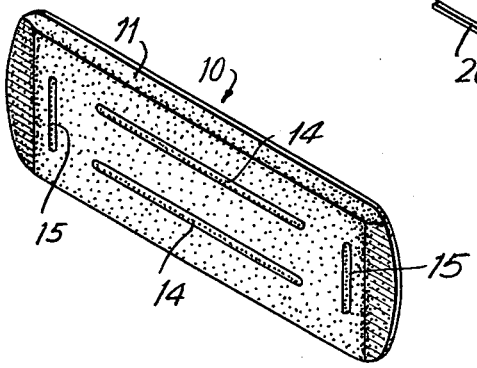
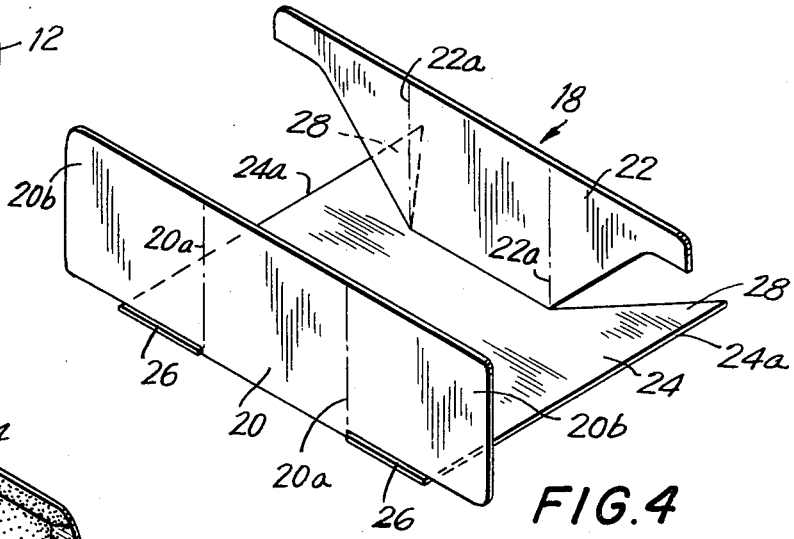
FIG. 4
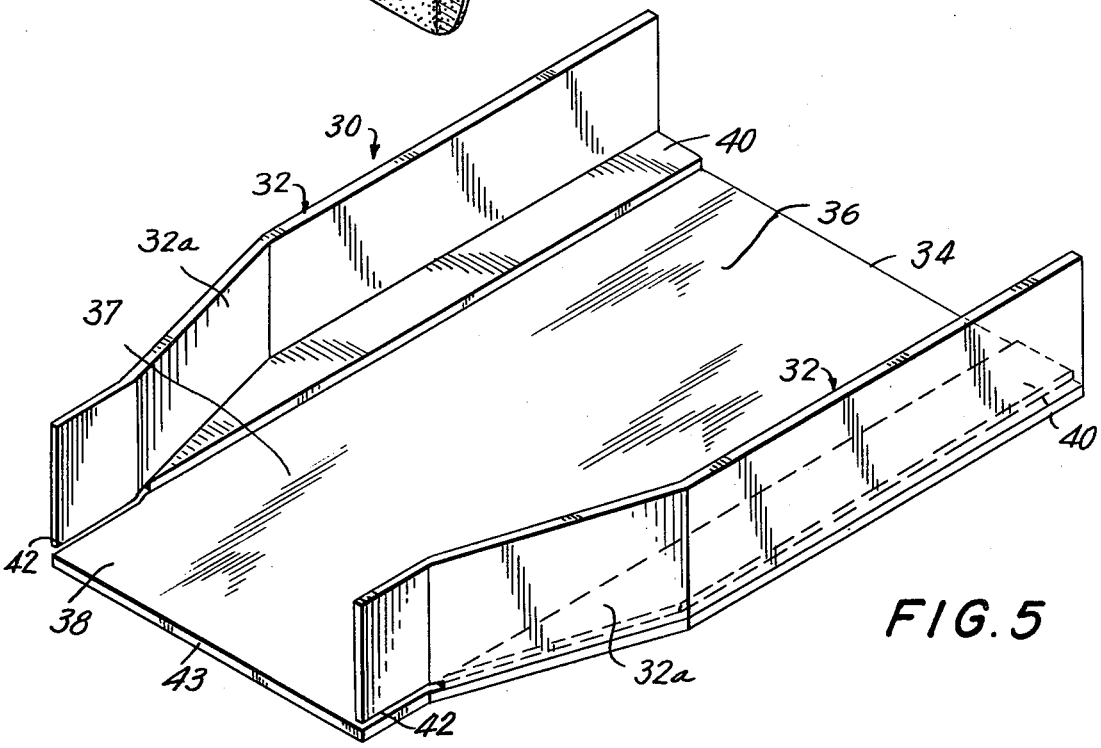
FIG. 5

FIG. 6
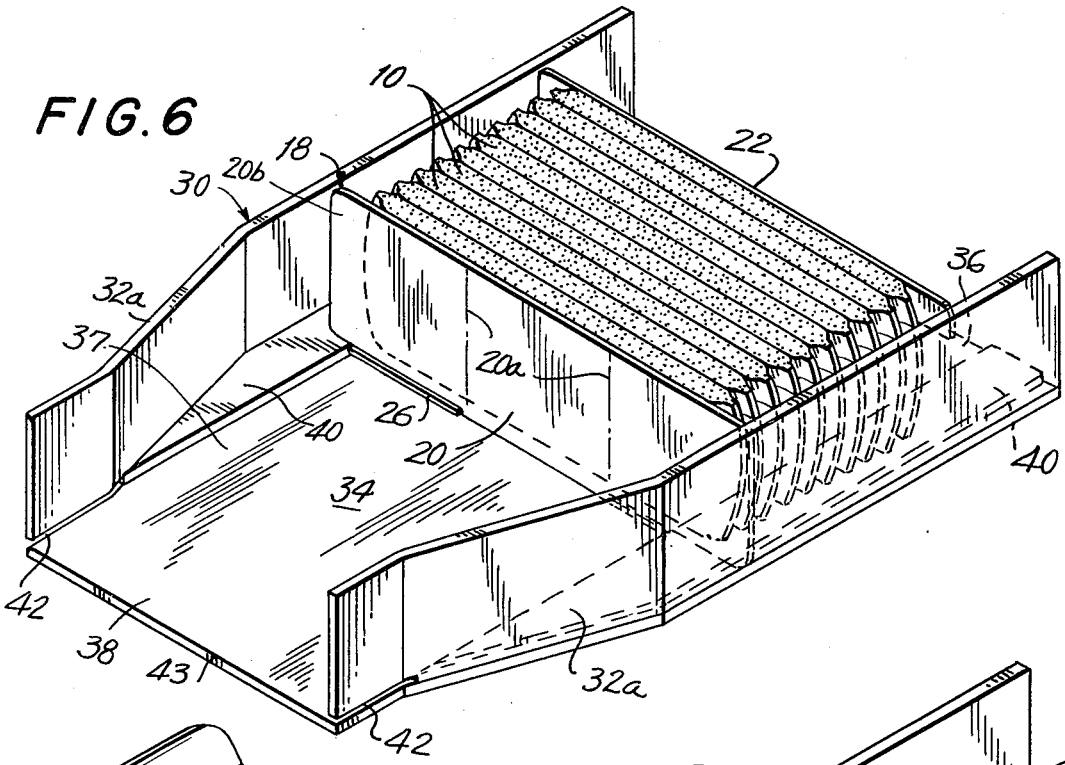
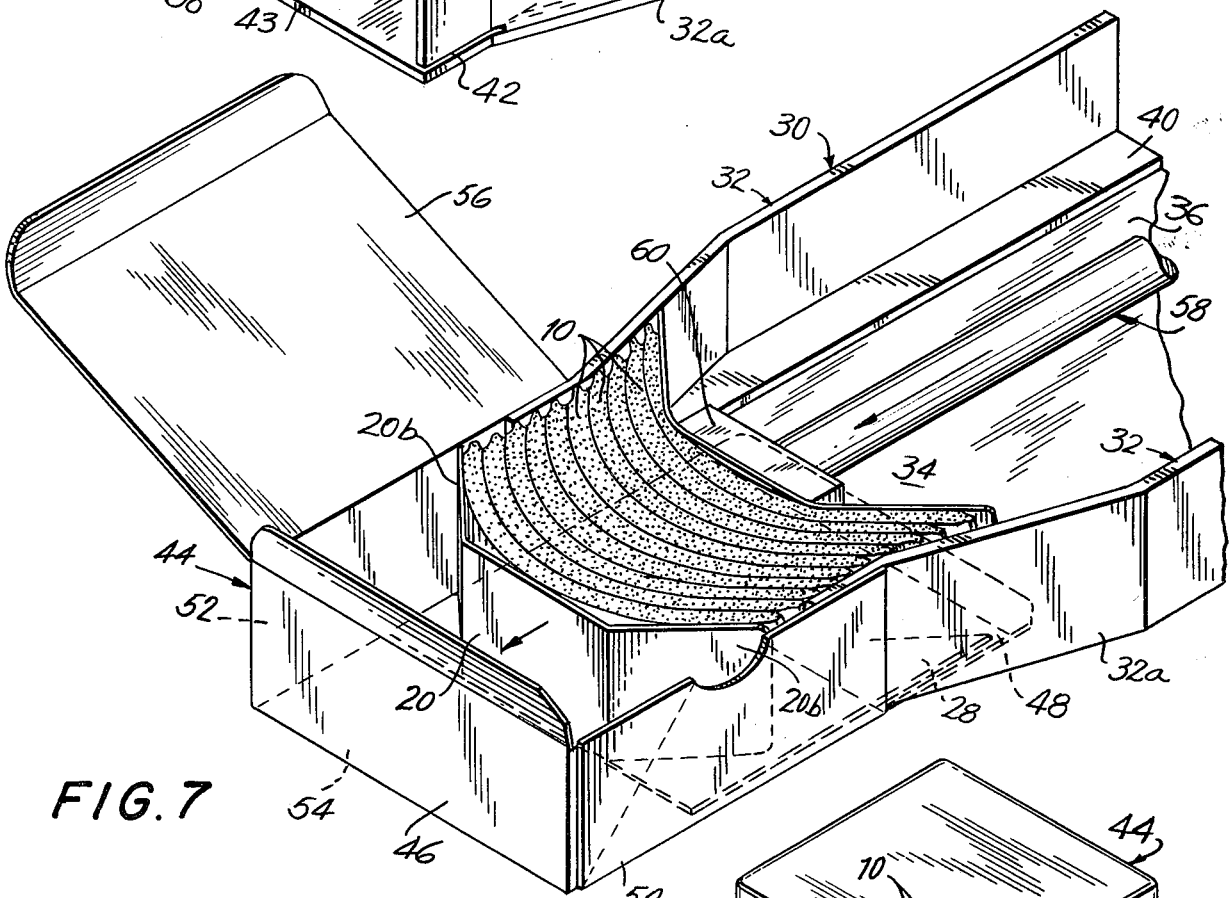
FIG. 7
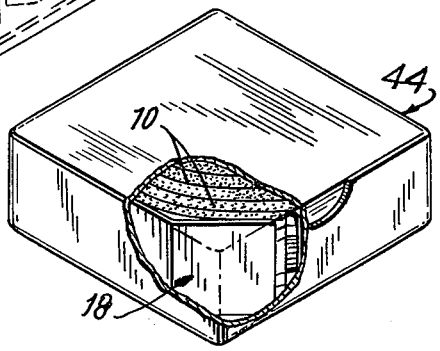
FIG. 8

METHOD FOR PRODUCING NON-PLANAR SANITARY NAPKINS

TECHNICAL FIELD

This invention relates to sanitary napkins. More particularly, the invention relates to a method for the simultaneous packaging and shaping of non-planar sanitary napkins.

BACKGROUND ART

It is known to provide sanitary napkins, including maxi-pads, mini-pads, shields or the like, in non-planar arcuate configurations. Sanitary napkins of this type are described, for example, in U.S. Pat. Nos. 1,192,439; 2,964,041; 3,236,238; 3,262,451; 3,407,814; 3,411,504; 3,430,630; 3,445,897; 3,575,174; 3,621,847; 3,677,249; and 3,696,187.

Conventionally, such non-planar sanitary napkins are produced by the use during the manufacturing operation of an arcuate forming head, employing sufficient heat and pressure to impart the desired configuration to the napkins. See, for example, Glassman U.S. Pat. No. 3,696,187. It is also known to produce arcuate or otherwise curved sanitary napkins employing a heat shrinkable material for the cover of the napkin, whereby the application of heat shrinks the cover, thereby curving the pad. This technique is described, for example, in Ashton Pat. No. 2,964,041, and Morse Pat. Nos. 3,262,451 and 3,236,238. Other techniques for forming curved sanitary pads are disclosed in the further patents referred to hereinabove.

It is among the objects of the present invention to provide a method for producing non-planar sanitary napkins which is easier, less-costly, and may be carried out more efficiently than these previously proposed techniques. A further object of the invention is to provide such a method in which shaping of the sanitary napkins is effected concurrently with the final packaging thereof, without the addition of independent shaping operations.

DISCLOSURE OF THE INVENTION

These and other objects are accomplished by means of the present invention which comprises a method for packaging and shaping sanitary napkins in a container. The method comprises advancing a succession of pre-moistened, embossed sanitary napkins along a pre-determined path, deflecting the ends of the napkins to impart an arcuate shape thereto, introducing the napkins into a container which maintains their arcuate shape, and reducing the moisture content in the napkins. When simultaneously packaged and shaped in this manner, the sanitary napkins retain their arcuate shapes after they are removed from their containers.

In this specification, the method of the invention is principally described in connection with the formation of shaped, embossed panty liners or shields. Such products conventionally comprise a relatively thin internal absorbent layer constituted of cellulosic fibers or the like, an external moisture-permeable cover or wrapper constituted of a non-woven polyester or similar material, a moisture-impermeable backing layer, e.g., a polyethylene film, and an adhesive strip or strips on the backing layer for removably securing the liner to the panties. Shields of this general type are disclosed, for example, in U.S. Pat. Nos. 3,001,201; 3,044,467; 3,315,677; 3,463,154; 3,477,433; 3,570,491; and 4,023,570. Shields found particularly useful in the present method are embossed both longitudinally and laterally with a "fin and vane" pattern such as described in U.S. Pat. No. 3,411,504.

It will, however, be understood that the present method may be utilized in the manufacture of any type of non-planar, shaped and embossed sanitary napkins, including shaped maxi-pads or mini-pads as well as shield products. Alternatively, the napkins utilized in the method hereof may be of any conventional design, e.g., they may be embossed in other patterns or may incorporate any conventional additives, e.g., superabsorbents. Accordingly, as used herein the term "sanitary napkins" is intended to include all such catamenial pads or products.

BRIEF DESCRIPTION OF THE DRAWINGS

In the drawings, wherein like reference numerals represent like parts:

FIG. 1 is a perspective view of a flat, embossed sanitary napkin, viewed from the direction of its moisture-proof backing layer, before being shaped in accordance with the present invention;

FIG. 2 is a perspective view of the flat, embossed sanitary napkin of FIG. 1, viewed from the side opposite that illustrated in FIG. 1, and showing its embossed, moisture-permeable wrapper;

FIG. 3 is a perspective view of the sanitary napkin, viewed in the same direction as in FIG. 1, after it has been shaped in accordance with the method of the invention;

FIG. 4 is a perspective view of a nesting tray employed to practice the inventive method;

FIG. 5 is a perspective view of a forming tray employed to practice the method of the invention;

FIG. 6 is a perspective view illustrating one step in the method of the present invention wherein the nesting tray is received in the forming tray, the nesting tray being loaded with a plurality of flat sanitary napkins;

FIG. 7 is a perspective view illustrating another step in the method wherein the nesting tray is forced through the narrow end of the forming tray and into a box for the sanitary napkins, the plurality of napkins being simultaneously shaped into the desired non-planar configuration; and FIG. 8 is a perspective view, partly broken away, showing the box closed with the nesting tray and non-planar napkins therein.

BEST MODE FOR CARRYING OUT THE INVENTION

Referring now to the drawings, and initially to FIG. 3 thereof, a curved or arcuate sanitary napkin of the type to be formed in accordance with the present invention is generally designated by the reference numeral 10. The composition of the napkin 10 is conventional, and may comprise a debonded pulp retained within a nonwoven, moisture permeable rayon wrapper 11 having a moisture-proof, polyethylene backing 12. Typically, the backing 12 is provided with longitudinally extending non-toxic adhesive layers covered by release strips 13, which releasably secure the napkin 10 to the crotch portion of a panty or girdle.

Referring to FIGS. 2 and 3, the napkin 10 is initially formed in a substantially planar configuration. It is embossed with a pair of longitudinally extending channels or fins 15 and spaced laterally extending channels or vanes to facilitate distribution of fluid within the napkin.

In accordance with the invention, the napkin is pre-moistened by adding water thereto. The water may be added during forming of the napkin 10, or by spraying the napkin after forming. Typically, the initial moisture content of the napkin 10 is about 2–5% by weight of the dry pulp or other absorbent constituent thereof. In accordance herewith the moisture content is initially increased to about 7–100% by weight of the absorbent, preferably to about 7–30%. Most desirably, the moisture content is increased to about 14–25% by weight of the pulp or other absorbent.

Referring now to FIG. 4, a nesting tray for supporting a plurality of the napkins 10 during the simultaneous packaging and forming process of the invention is generally designated by the reference numeral 18. As shown, the nesting tray 18 comprises a front wall 20, a rear wall 22, and a bottom wall 24 connecting the front and rear walls. Preferably, the lengths of the front wall 20 and rear wall 22 are substantially equal to the length of the napkins 10 when the napkins are flat. For reasons that will be apparent hereinafter, the bottom wall 24 is preferably provided with a pair of extensions or fins 28 which extend beyond the rear wall 22 on either side thereof. For reasons that will also be apparent hereinafter, the front wall 20 and rear wall 22 are each preferably provided with a pair of parallel fold lines **20*a* and 22*a*, respectively. As shown, slits 26 are provided between the bottom wall 24 and the front wall 20 to accommodate folding of the front wall portions 20*b* on either side of the fold lines 20*a*, the slits 26 extending from the fold lines 20*a* to the edges 24*a* of the bottom wall 24**.

The nesting tray 18 is suitably formed of an inexpensive, moisture permeable, flexible material, such as cardboard. Preferably, the nesting tray 18 is formed from a single piece of cardboard, thus accounting for the irregular shape of the rear wall 22.

Referring now to FIG. 5, a forming tray for imparting the desired curvature to the napkins 10 is generally designated by the reference mumeral 30. The forming tray comprises a pair of side walls 32 connected by a bottom wall 34. As shown, the side walls 32 include angled portions **32*a* for defining a widened section 36 at one end of the tray 30, a tapered intermediate section 37, and a narrowed section 38 at the other end. For reasons that will be apparent hereinafter, a pair of shoulders 40 are provided on the bottom wall 34, the shoulders 40 extending through the widened and intermediate sections 36, 37 of the tray 30. For reasons that will also be apparent hereinafter, slots 42 are provided in the portion of the side walls 32 extending from the shoulders 40 to the narrow end 43 of the tray 30. Desirably, the forming tray 30** is comprised of plastic.

As indicated hereinabove, the successive steps of the method of the invention are illustrated in FIGS. 6, 7 and 8 of the drawings. Referring initially to FIG. 6, the pre-moistened, substantially planar, flat napkins 10 are initially disposed in front to back relation between the front wall 20 and rear wall 22 of the nesting tray 18. As shown in FIG. 6, the spacing between the walls 20 and 22 is sufficient to accommodate ten napkins. This, however, is not necessary , and the spacing between the walls 20 and 22 may be selected to accommodate a lesser or greater number of napkins, dependent upon the specific size package to be filled.

Still referring to FIG. 6, the nesting tray 18 is initially disposed in the widened section 36 of the forming tray 30. With the nesting tray 18 so disposed, it is apparent from FIG. 6 that the bottom wall 24 of the nesting tray 18 rests on the bottom wall 36 of the forming tray 30 between the shoulders 40. Thus, the shoulders 40 serve as guides to center the nesting tray 18 within the forming tray 30. The ends of the front and rear walls 20, 22 of the nesting tray 18, as well as the ends of the flat napkins 10, extend over the shoulders 40 into close confronting relation with the side walls 32 of the forming tray 30.

In accordance with the invention, simultaneous packaging and shaping of the group of napkins within nesting tray 18 is effected by intermittently inserting the forming tray 30 into one end of a box 44 in which the napkins are to be packaged. The forming tray may be thus reciprocated into sequential boxes to be loaded, employing conventional packaging means (not illustrated). When thus positioned, the narrow section 38 of the forming tray 30 is disposed in an open side of the box 44, as shown in FIG. 7.

Preferably, the box 44 is the same box in which the sanitary napkins 10 are ultimately sold. The box is preferably provided of a conventional moisture-permeable material, e.g., a standard, sulfite-bleached white cardboard. It is suitably rectilinear in cross-section, comprising the usual side walls 46, 48, front wall 50, rear wall 52, bottom wall 54 and a cover 56. It may be seen from FIG. 7 that the box 44 is dimensioned for a close fit with the narrow section 38 of the tray 30. To accommodate placement of the narrow section 38 in the box 44, the side wall 48 is folded down into substantially coplanar relation with the bottom wall 54 such that the side wall 48 may be disposed under the forming tray 30. The box cover 56 may either be open (as shown in FIG. 7) defining a so-called tuck box, or closed (defining a glued-end box) during this step of the method.

The nesting tray 18 is then advanced toward the narrowed end of the forming tray 30. As illustrated in FIG. 7, this may be accomplished by employing a piston 58 having a head 60 dimensioned to fit between the fold lines **22*a* in the rear wall 22 of the nesting tray 18. As will be apparent from FIG. 7, as the nesting tray 18 passes through the tapered intermediate section 37 of the forming tray 30, the front and rear walls 20, 22, as well as the napkins 10 disposed therebetween, are gradually flexed until they are sufficiently arcuate to pass through the narrowed section 38 of the tray 30 and from there into the box 44. The front and rear walls 20, 22 will inherently flex about the fold lines 20*a*, 22*a*, thereby insuring that a symmetrical curvature is imparted to the napkin 10. As the rearmost napkins are flexed, their ends will be supported by the extensions 28 of the bottom wall 24**.

As the nesting tray 18 passes through the narrowed section 38 of the forming tray 30, the lateral edges of the bottom wall 24 of the nesting tray pass through the slots 42 and into close confronting relation with the front and rear wallls 50, 52 of the box 44. This serves to center the nesting tray 18 and napkins 10 within the box 44, whereby the napkins retain their desired symmetrical curvature. The degree of curvature imparted to the napkins 10 is predetermined by proper selection of the width of the narrowed section 38 of the forming tray 30, which corresponds to the spacing between the front and rear walls 50, 52 of the box 44. Once the entire nesting tray 18 is moved through the narrow section 38 of the forming tray 30 and into the box 44, the forming tray 30 and piston 58 are removed.

With the napkins 10 retained in their curved configuration by the box 44, their moisture content is reduced. Preferably, sufficient moisture is removed to reduce the moisture content of the napkins to equilibrium levels approximately 2–5% by weight of the dry absorbent. These moisture levels may be achieved by allowing the excess moisture to evaporate. The period of time required to effect such evaporation will vary, depending upon ambient temperature and humidity conditions, whether the bob utilized is left open or closed and/or overwrapped with a moisture barrier, or whether the permeability of the final package is otherwise varied. If desired, a vacuum may be applied to the box to speed the moisture reduction process.

Upon reduction of the moisture content of the napkins to approximately 2–5% by weight of the absorbent on a dry basis, a set is imparted to the napkins enabling them to retain their non-planar, arcuate shape upon removal from the box 44 for individual use. It is believed that the moisture reduction stabilizes the non-planar configuration of the napkins by means of hydrogen bonding. It will, however, be understood that the invention is not restricted to this proposed mechanism.

The range of initial moisture content suitable for use in the practice of the method of the invention was determined by the following experiment.

Sample pads, previously manufactured were sprayed with 7, 14, 20, 30, 50 and 100% water based on a 1.8 gm. pulp weight. The pads were then embossed flat with the fin 14 and vane 15 pattern. The pads were manually curved and packaged in 10's count white boxes without a film overwrap. Samples of curved panty shields machine shaped as illustrated in FIGS. 6–8 and formed at 14% moisture add-on were manufactured as control pads. The products were aged for 7 days at ambient conditions, were evaluated for curvature esthetics, and were subjected to a standard test for determining the peak force (in grams) required to compress the curved pads into a planar configuration. The pads formed as described below were compared with machine formed pads as described in U.S. Pat. No. 3,411,504. The following results were obtained:

| Moisture Add-On (Percent of Pulp Weight) | Compression Force (Gm.) | Curvature Appearance |
|---|---|---|
| 7% | 9.9 | Fair |
| 14% | 13.0 | Good |
| 20% | 13.8 | Good |
| 30% | 18.9 | Good |
| 50% | 18.8 | Good |
| 100% | 19.1 | Good |
| 14% machine shaped | 18.1 | Excellent |

The compression force was found to plateau at approximately 30% moisture. However, at this moisture level and above the dampness of the pads caused the cardboard boxes to become wet, resulting in some initial deformation of the carton and the insert until the boxes dried out. This was not observed at the 20% level or below. The optimum moisture level range appeared to be from 14–25%. In this range, acceptable pad curvature was obtained as well as resistance to compression, both without distorting the boxes for the napkins.

While a preferred embodiment of the invention has been described and illustrated herein, those skilled in the art will appreciate that various changes may be made therein without departing from the scope of the invention. For example, the method may be automated with the premoistened flat napkins 10 being automatically loaded into the nesting trays 18, and the loaded nesting trays 18 and boxes 44 being automatically moved into position at either end of the forming tray 30. Accordingly, the above description should be construed as illustrative and not in a limiting sense, the scope of the invention being defined by the following claims.

I claim:

1. A method for packaging and shaping sanitary napkins in a container, comprising:

(a) advancing a succession of pre-moistened, substantially planar, embossed sanitary napkins along a predermined path;

(b) deflecting the ends of said napkins to impart a non-planar shape thereto;

(c) introducing said napkins into a container which maintains their non-planar shape; and (d) reducing the moisture content in said napkins, thereby fixing the curvature of said napkins so that they retain their non-planar shape when removed from said container.

2. The method of claim 1, wherein said napkins comprise an absorbent material constituent, the moisture content of said napkins prior to step (c) is from 7–100% by weight of the absorbent material constituent, and the moisture content of said napkins after step (d) is from 2–5% by weight of the absorbent material constituent.

3. The method of claim 1 wherein the ends of said pre-moistened napkins are deflected substantially equally to impart a substantially symmetrical, arcuate curvature to said napkins.

4. The method of claim 1, wherein the napkins are pre-moistened by adding water thereto during forming of the napkins or by water-spraying after forming thereof.

5. The method of claim 1, wherein the moisture content of said napkins is reduced by evaporation.

6. The method of claim 1, wherein each of said napkins incorporates a pair of embossed channels extending longitudinally thereof and a pair of embossed channels extending laterally thereof.

7. The method of claim 1, wherein the container is moisture-permeable.

8. The method of claim 1, wherein said deflecting step comprises passing said napkins laterally through a forming tray having tapered side walls defining a section of reduced width which is narrower than the length of said napkins in their initial, substantially planar form.

9. The method of claim 8, wherein a plurality of said napkins are disposed in front to back relation in a nesting tray having deformable front and rear walls connected by a bottom wall, the nesting tray with the napkins therein is advanced through the reduced width section of the forming tray to deflect the ends of the napkins, the reduced width section of the forming tray is introduced into an open side of the container, the nesting tray is fed through the reduced width section into the container, the forming tray is removed from the container, and the container is sealed.

* * * * *